US010832606B2

(12) United States Patent
Kim et al.

(10) Patent No.: US 10,832,606 B2
(45) Date of Patent: Nov. 10, 2020

(54) DISPLAY DRIVING DEVICE

(71) Applicant: SILICON WORKS CO., LTD., Daejeon-si (KR)

(72) Inventors: Young Bok Kim, Daejeon (KR); Beom Rak Choi, Daejeon (KR)

(73) Assignee: Silicon Works Co., Ltd., Daejeon-si (KR)

( * ) Notice: Subject to any disclaimer, the term of this patent is extended or adjusted under 35 U.S.C. 154(b) by 0 days.

(21) Appl. No.: 16/198,308

(22) Filed: Nov. 21, 2018

(65) Prior Publication Data

US 2019/0156716 A1 May 23, 2019

(30) Foreign Application Priority Data

Nov. 23, 2017 (KR) ..... 10-2017-0157025

(51) Int. Cl.

| | |
|---|---|
| ***G09G 3/00*** | (2006.01) |
| ***G09G 3/20*** | (2006.01) |
| ***G09G 3/3275*** | (2016.01) |
| ***G09G 3/36*** | (2006.01) |

(52) U.S. Cl.

CPC ..... *G09G 3/006* (2013.01); *G09G 3/20* (2013.01); *G09G 3/3275* (2013.01); *G09G 3/3685* (2013.01); *G09G 2330/045* (2013.01); *G09G 2330/12* (2013.01)

(58) Field of Classification Search

CPC .. G09G 3/006; G09G 2330/12; G09G 3/2096; G09G 2310/0275; Y10S 345/904; Y10S 324/00; Y10S 505/842; Y10S 505/843

See application file for complete search history.

(56) References Cited

U.S. PATENT DOCUMENTS

| | | | | |
|---|---|---|---|---|
| 5,377,030 | A * | 12/1994 | Suzuki | G02F 1/1309 324/71.3 |
| 7,145,358 | B2 | 12/2006 | Ando | |
| 2003/0034941 | A1* | 2/2003 | Janssen | G09G 3/3648 345/87 |
| 2006/0164375 | A1* | 7/2006 | Kim | G09G 3/3685 345/100 |
| 2012/0032938 | A1* | 2/2012 | Park | G09G 3/3208 345/211 |
| 2013/0134986 | A1* | 5/2013 | Yun | G09G 3/20 324/543 |

(Continued)

FOREIGN PATENT DOCUMENTS

| | | |
|---|---|---|
| KR | 10-2017-0002098 | 1/2017 |
| KR | 10-2017-0099421 | 9/2017 |
| KR | 10-1816256 | 1/2018 |

*Primary Examiner* — Nitin Patel
(74) *Attorney, Agent, or Firm* — Polsinelli PC

(57) ABSTRACT

Disclosed is a display driving device capable of determining whether a display panel is shorted, based on a voltage level shared by data lines. The display driving device may include: a data driving unit configured to provide source driving signals to data lines of a display panel in a data output period, and control the data lines to share charges in a charge sharing period; and a short monitoring unit configured to detect a voltage level shared in the charge sharing period, and compare the voltage level with a reference voltage that varies according to the voltage level to monitor whether the display panel is shorted.

14 Claims, 3 Drawing Sheets

(56) References Cited

U.S. PATENT DOCUMENTS

| | | | | |
|---|---|---|---|---|
| 2017/0069270 | A1* | 3/2017 | Hyeon | G09G 3/3216 |
| 2019/0279585 | A1* | 9/2019 | Suzuki | G02F 1/13306 |
| 2020/0027379 | A1* | 1/2020 | Kim | G01R 31/2825 |

* cited by examiner

DISPLAY DRIVING DEVICE

BACKGROUND

1. Technical Field

The present disclosure relates to a display device, and more particularly, to a display driving device capable of monitoring whether a display panel is shorted.

2. Related Art

A display device includes a display panel, a display driving device and a timing controller. The display driving device converts digital image data provided from the timing controller into a source driving signal, and provides the source driving signal to the display panel.

The display driving device includes a digital-analog converter (DAC) for converting the digital image data into the source driving signal and an output circuit for outputting the source driving signal to data lines of the display panel. Such a display driving device performs an operation of providing the source driving signal to the data lines of the display panel or controlling the data lines to share charges, according to a source output enable signal.

When a physical short circuit occurs between the data lines and adjacent lines in the display panel, a short current may flow into the display panel. When the surface temperature of the display panel rapidly rises due to the short current, a safety problem may occur.

Therefore, there is a demand for a technique for solving a safety problem which may occur due to a short current.

SUMMARY

Various embodiments are directed to a display driving device capable of monitoring whether a display panel is shorted.

In an embodiment, a display driving device may include: a data driving unit configured to provide source driving signals to data lines of a display panel in a data output period, and control the data lines to share charges in a charge sharing period; and a short monitoring unit configured to detect a voltage level shared in the charge sharing period, and compare the voltage level with a reference voltage that varies according to the voltage level to monitor whether the display panel is shorted.

In an embodiment, a display driving device may include: a first switch circuit configured to control data lines of a display panel to share charges in a charge sharing period; a second switch circuit configured to transfer a shared voltage level when the charges of the data lines are shared through the first switch circuit; and a short monitoring unit configured to monitor whether a display panel is shorted, by comparing the voltage level detected by the second switch circuit with a reference voltage that varies according to the voltage level.

In an embodiment, a display driving device may include: a data driving unit configured to control data lines of a display panel to share charges in a charge sharing period; a switch configured to transfer a voltage level which is shared by the data lines through the data driving unit; a comparator configured to compare the voltage level with a reference voltage that varies according to the voltage level, and output a detection signal corresponding to the comparison result; and a controller configured to determine whether a short path is present in the display panel, according to the detection signal of the comparator, and output a control signal for powering down the data driving unit, when determining that a short path is present in the display panel.

DETAILED DESCRIPTION

Figure 1:
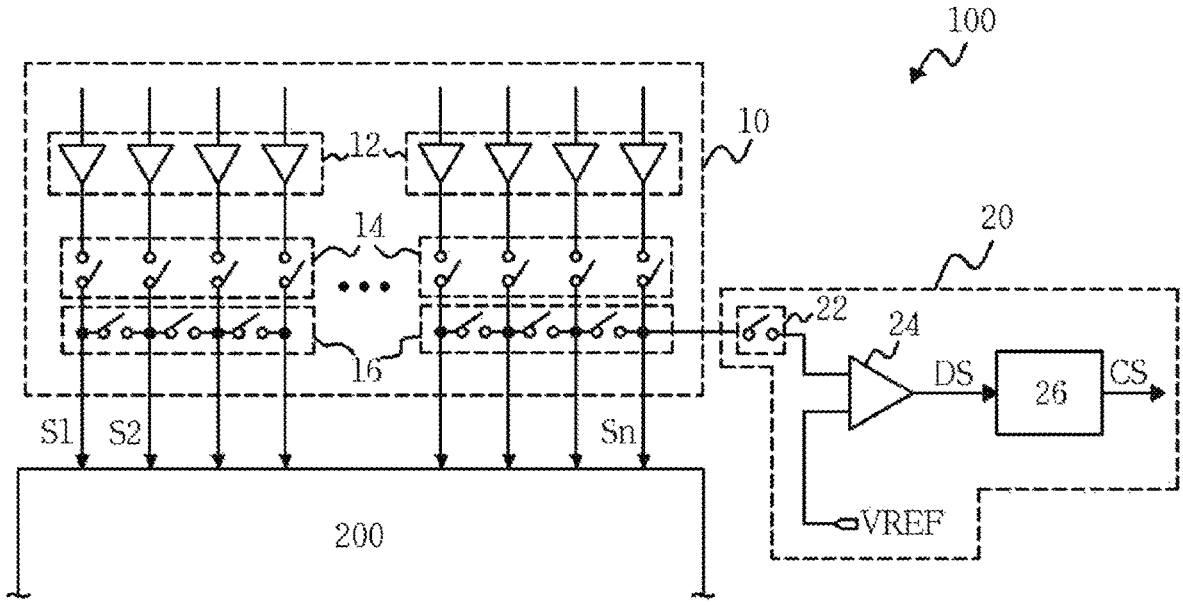
FIG. 1 is a circuit diagram for describing a display driving device in accordance with an embodiment of the present invention.

Hereafter, embodiments of the present invention will be described in detail with reference to the accompanying drawings. The terms used in this specification and claims are not limited to typical dictionary definitions, but should be interpreted as meanings and concepts which coincide with the technical idea of the present invention.

Embodiments described in this specification and configurations illustrated in the drawings are preferred embodiments of the present invention, and do not represent the entire technical idea of the present invention. Thus, various equivalents and modifications capable of replacing the embodiments and configurations may be provided at the time that the present application is filed.

FIG. 1 is a block diagram for describing a display driving device 100 in accordance with an embodiment of the present invention.

Referring to FIG. 1, the display device includes a display panel 200 and a display driving device 100.

The display panel 200 may include a liquid crystal panel, an OLED (Organic Light Emitting Diode) panel and the like. The display panel 200 includes data lines, gate lines, power supply lines and sensing lines formed therein, and pixels may be formed in a matrix shape at the respective intersections between the data lines and the gate lines.

The display driving device 100 performs a driving operation of providing a source driving signal to the display panel in a data output period, and performs a charge sharing operation of controlling the data lines of the display panel to share charges in a charge sharing period.

The display driving device 100 receives digital image data from a timing controller (not illustrated) in the data output period, and provides source driving signals S1 to Sn corresponding to the digital image data to the data lines of the display panel 200.

The display driving device 100 controls internal switches in order for the data lines of the display panel 200 to charge shares in the charge sharing period. When a physical short circuit occurs between the data lines and adjacent lines in the display panel 200, a short current may flow into the display panel 200. The display driving device 100 in accordance with the embodiment of the present invention may monitor whether the display panel 200 is shorted, using a voltage level shared by the data lines in the charge sharing period.

The display driving device includes a data driving unit 10 and a short monitoring unit 20.

Referring to FIG. 1, the data driving unit 10 includes a buffer circuit 12, a switch circuit 14 and a switch circuit 16. The buffer circuit 12 buffers the source driving signals S1 to Sn corresponding to the digital image data, the switch circuit 14 transfers the source driving signals S1 to Sn to the data lines of the display panel 200, and the switch circuit 16 controls the data lines of the display panel 200 to share their charges.

The switch circuit 14 is turned on to transfer the source driving signals S1 to Sn to the data lines in the data output period, and the switch circuit 16 is turned on to electrically connect the data lines to share charges in the data sharing period.

Although not illustrated in FIG. 1, the data driving unit 10 may include a latch circuit for latching the digital image data provided from the timing controller and a digital-analog converter (DAC) for converting the digital analog data into the source driving signals S1 to Sn as analog signals.

The short monitoring unit 20 may detect a voltage level shared through the turn-on of the switch circuit 16 in the charge sharing period, and compare the voltage level with a reference voltage that varies according to the voltage level to monitor whether the display panel is shorted.

The reference voltage VREF may be varied according to the voltage level shared in the charge sharing period, and set to a lower level than the shared voltage level. For example, gamma voltages for converting the digital image data into the source driving signals may be used as the reference voltage VREF. Alternatively, reference voltages generated through a separate reference voltage generator (not illustrated) may be used as the reference voltage VREF.

The short monitoring unit 20 includes a switch 22, a comparator 24 and a controller 26.

Referring to FIG. 1, the switch 22 is electrically coupled to the switch circuit 16 for controlling the data lines to share charges, and the switch circuit 16 transfers the charges shared by the data lines to the comparator 24. The switch circuit 16 may have a preset turn-on time enough for all of the data lines to share charges, and the switch 22 may be turned on after the time required for all of the data lines to share charges through the switch circuit 16.

The comparator 24 compares the voltage level transferred by the switch 22 to the set reference voltage VREF, and outputs a detection signal corresponding to the comparison result. When the voltage level is higher or lower than the reference voltage VREF, the comparator 24 outputs a high or low logic signal corresponding to the voltage level. The logic level of the detection signal outputted from the comparator 24 may be changed according to the design of the comparator 24.

When a short path is present in the display panel 200, the voltage levels of the data lines may be lower than the reference voltage VREF. That is, when a short path is present in the display panel 200, the comparator 24 outputs a set high or low logical signal.

The controller 26 determines whether a short path is present in the display panel 200, according to the logic level of the detection signal DS outputted from the comparator 24. When the detection signal DS is inputted as a high or low logic signal, the controller 26 determines that a short path is present in the display panel 200, and enables and outputs a control signal CS for powering down the data driving unit 10 which provides the source driving signal to the display panel.

The control signal CS may be used to power down the DAC for converting the digital image data into the source driving signals using gamma voltages in the data driving unit 10 or an output buffer for buffering and outputting the source driving signals. Alternatively, the control signal CS may be used to power down the display driving device 100 including the data driving unit 10.

For example, when the data driving unit 10 drives image data corresponding to black in the data output period, the voltage levels of the data lines may converge to a half supply voltage (½ VDD) in the charge sharing period. When a short path is present in the display panel 200, the voltage levels of the data lines may be lower than the half supply voltage (½ VDD). When the voltage level is detected as a lower level than the set reference voltage, the short monitoring unit 20 may determine that a short path is present in the display panel 200.

In order to improve the detection accuracy of the shared voltage level, the data lines of the display panel 200 may be divided into groups each including a predetermined number of data lines, and the short monitoring unit 20 may be provided for each of the groups to monitor the voltage level.

Figure 2:
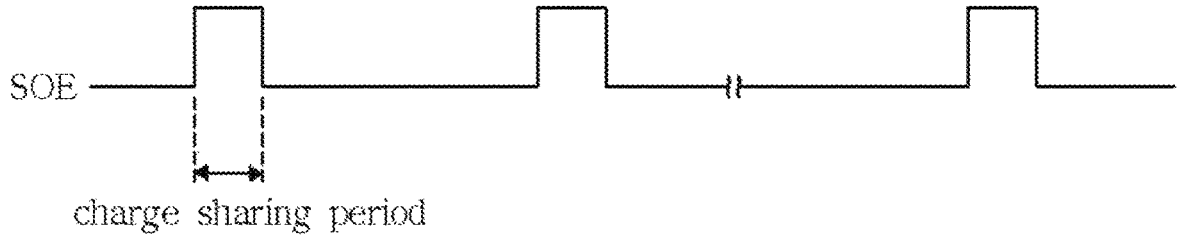
FIG. 2 is a waveform diagram for describing operations of switch circuits illustrated in FIG. 1.

FIG. 2 is a waveform diagram for describing operations of the switch circuits illustrated in FIG. 1.

Referring to FIGS. 1 and 2, the switch circuits 14 and 16 may be turned on or off according to the logic level of a source output enable signal SOE. For example, suppose that the source output enable signal SOE is inputted at a logic low level in the data output period, and inputted at a logic high level in the charge sharing period. However, the present embodiment is not limited thereto.

When the source output enable signal SOE is inputted at a logic low level in the data output period, the switch circuit 14 is turned on, and the switch circuit 16 is turned off. Then, the source driving signals S1 to Sn corresponding to the digital image data are provided to the display panel 200.

When the source output enable signal SOE is inputted at a logic high level in the charge sharing period, the switch circuit 14 is turned off, and the switch circuit 16 is turned on. Then, charges of all the data lines are shared. The short monitoring unit 20 may be enabled in the charge sharing period. For example, the charge sharing period may be set to a vertical blank period of the display device. That is, the short monitoring unit 20 may be configured to monitor whether the display panel is shorted, in the vertical bland period.

The shared voltage level may correspond to a level at which the source driving signals corresponding to the data image data provided from the timing controller are shared, and the reference voltage may be varied according to the shared voltage level, and set to a lower level than the shared voltage level.

In the present embodiment, it is described that the source driving signals are shared at the voltage level corresponding to the digital image data provided from the timing controller. However, the source driving signals may be shared at a voltage level corresponding to set data in the charge sharing period. In this case, the reference voltage may be set to a fixed value lower than a voltage level corresponding to the set data.

Figure 3:
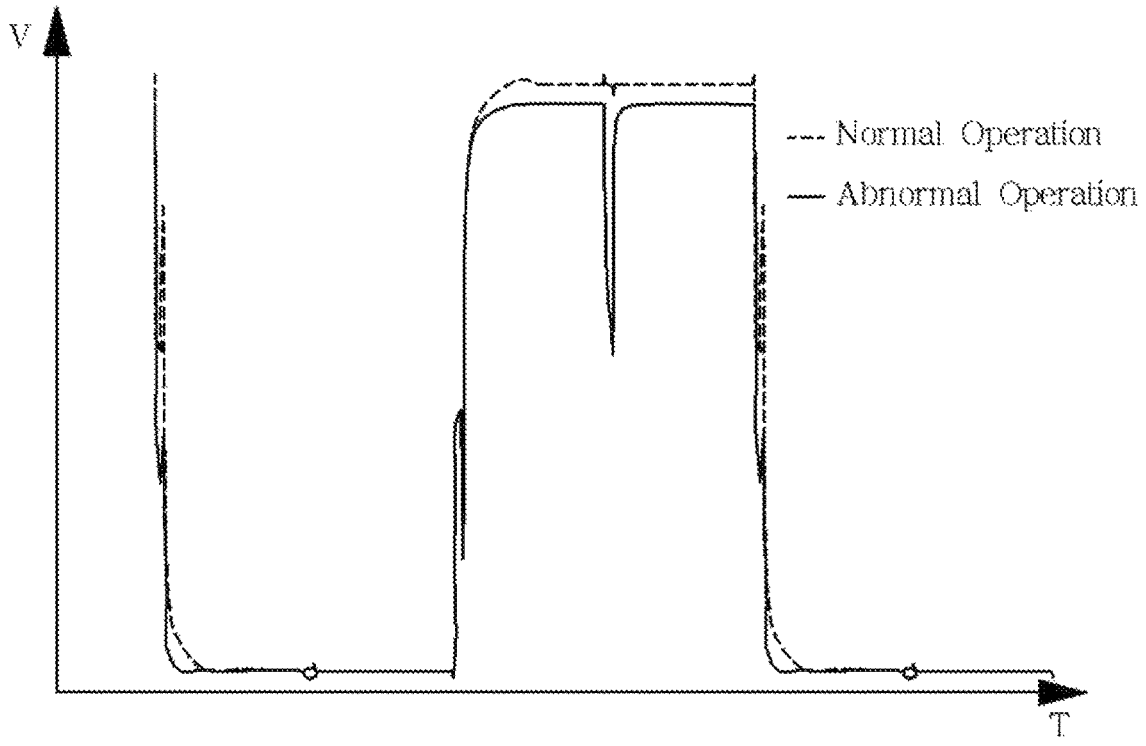
FIG. 3 is a waveform diagram illustrating a data output when a ground voltage short circuit occurs in a display panel of FIG. 1.

FIG. 3 is a waveform diagram illustrating a data output when a ground voltage short circuit occurs in the display panel of FIG. 1.

In FIG. 3, a dotted line represents a data output during a normal operation, and a solid line represents a data output during an abnormal operation. As illustrated in FIG. 3, when a ground voltage short circuit occurs in the display panel, the data output becomes lower than during the normal operation. In this way, by monitoring the voltage levels of the data lines, it is possible determine whether the display panel is shorted.

As described above, the display driving device in accordance with the embodiment of the present invention may monitor the voltage level shared in the charge sharing period, thereby determining whether the display panel is shorted.

When determining that a short path is present in the display panel, the display driving device may power down the data driving unit for providing the source driving signals to the display panel, thereby preventing a safety problem that the temperature of the display panel rapidly rises due to a short current.

While various embodiments have been described above, it will be understood to those skilled in the art that the embodiments described are by way of example only. Accordingly, the disclosure described herein should not be limited based on the described embodiments.

What is claimed is:

1. A display driving device comprising:

a data driving unit configured to provide source driving signals corresponding to an image data to data lines of a display panel in a data output period, and control switch circuits to share charges of the data lines in a charge sharing period;

a switch configured to detect a voltage level shared of the data lines in the charge sharing period;

a comparator configured to compare the voltage level with a reference voltage and output a detection signal corresponding to the comparison result; and a controller configured to determine whether a short of the data lines according to the detection signal, wherein the reference voltage is set to vary according to the voltage level at which the source driving signals corresponding to the image data are shared.

2. The display driving device of claim 1, wherein the reference voltage is set to a lower level than the shared voltage level.

3. The display driving device of claim 1, wherein the controller determines that a short path is present in the display panel, when the shared voltage level is lower than the reference voltage.

4. The display driving device of claim 3, wherein the controller powers down the data driving unit, when determining that a short path is present.

5. The display driving device of claim 1, wherein the switch, the comparator and the controller are configured for each group including a predetermined number of data lines.

6. The display driving device of claim 1, wherein the controller outputs a control signal for powering down the data driving unit, when determining that a short path is present in the display panel.

7. A display driving device comprising:

a first switch circuit configured to provide source driving signals corresponding to an image data to data lines of a display panel in a data output period;

a second switch circuit configured to connect the data lines to share charges in a charge sharing period;

a switch configured to transfer a voltage level of the data lines when the charges of the data lines are shared through the second switch circuit;

a comparator configured to compare the voltage level with a reference voltage and output a detection signal corresponding to the comparison result; and a controller configured to determine whether a short of the data lines according to the detection signal, wherein the reference voltage is set to vary according to the voltage level at which the source driving signals corresponding to the image data are shared.

8. The display driving device of claim 7, wherein the switch is set to be turned on after the charges of all of the data lines are shared by the second switch circuit.

9. The display driving device of claim 7, wherein the reference voltage is set to a lower level than the shared voltage level.

10. The display driving device of claim 7, wherein the controller determines that a short path is present in the display panel, when the shared voltage level is lower than the reference voltage.

11. The display driving device of claim 7, wherein the switch, the comparator and the controller are configured for each group including a predetermined number of data lines.

12. A display driving device comprising:

a data driving unit configured to provide source driving signals corresponding to an image data to data lines of a display panel in a data output period and control switch circuits to share charges of the data lines in a charge sharing period;

a switch configured to transfer a voltage level which is shared by the data lines through the data driving unit;

a comparator configured to compare the voltage level with a reference voltage, and output a detection signal corresponding to the comparison result; and a controller configured to determine whether a short of the data lines, according to the detection signal of the comparator, and output a control signal for powering down the data driving unit, when determining that a short path is present in the display panel, wherein the reference voltage is set to vary according to the voltage level at which the source driving signals corresponding to the image data are shared.

13. The display driving device of claim 12, wherein the reference voltage is set to a lower level than the shared voltage level.

14. The display driving device of claim 12, wherein when the detection signal indicating that the voltage level is lower than the reference voltage is inputted, the controller determines that a short path is present in the display panel, and enables the control signal for powering down the data driving unit.

* * * * *